US009126607B2

(12) United States Patent
Knapp et al.

(10) Patent No.: US 9,126,607 B2
(45) Date of Patent: Sep. 8, 2015

(54) ON-SITE ASSEMBLED FOUNDATION MODULE

(71) Applicants: Ryan W. Knapp, Sandy Hook, CT (US); Peter McGonagle, Southport, CT (US); Mark O'Donnell, Danbury, CT (US)

(72) Inventors: Ryan W. Knapp, Sandy Hook, CT (US); Peter McGonagle, Southport, CT (US); Mark O'Donnell, Danbury, CT (US)

(73) Assignee: THE MACTON CORPORATION, Oxford, CT (US)

( * ) Notice: Subject to any disclaimer, the term of this patent is extended or adjusted under 35 U.S.C. 154(b) by 51 days.

(21) Appl. No.: 14/085,489

(22) Filed: Nov. 20, 2013

(65) Prior Publication Data

US 2014/0261049 A1 Sep. 18, 2014

Related U.S. Application Data

(63) Continuation-in-part of application No. 13/826,001, filed on Mar. 14, 2013.

(51) Int. Cl.

| | |
|---|---|
| ***B61J 1/00*** | (2006.01) |
| ***B61J 1/04*** | (2006.01) |
| ***E02D 15/02*** | (2006.01) |

(52) U.S. Cl.

CPC . *B61J 1/04* (2013.01); *E02D 15/02* (2013.01); *Y10T 29/49947* (2015.01)

(58) Field of Classification Search

CPC ..... B61J 1/00; B61J 1/02; B61J 1/10; B60S 13/00; B60S 13/02

USPC ..... 104/35, 36, 44–48

See application file for complete search history.

(56) References Cited

U.S. PATENT DOCUMENTS

| | | | | |
|---|---|---|---|---|
| 5,086,704 | A * | 2/1992 | Mueller | 104/44 |
| 5,755,160 | A * | 5/1998 | Blufordcraving | 104/36 |
| 6,382,106 | B1 * | 5/2002 | Knight | 104/44 |
| 7,798,067 | B2 | 9/2010 | Starnes | |
| 7,966,939 | B2 * | 6/2011 | Holt | 104/35 |
| 2007/0175353 | A1 * | 8/2007 | Jeffs | 104/44 |

* cited by examiner

*Primary Examiner* — R. J. McCarry, Jr.

(74) *Attorney, Agent, or Firm* — St. Onge Steward Johnston & Reens LLC

(57) ABSTRACT

A device and method is disclosed for installing a turntable in a foundation. A foundation module having a base with a plurality of holes therein is used for installing the turntable. A first one of the plurality of holes is adapted to receive a foundation material there through for pouring a first section of the foundation and plurality of frame members are adapted to affix to the base. A form having an outer surface is adapted to secure to at least one of the plurality of frame members. The outer surface of the form is adapted retain a portion of the foundation material for pouring a second section of the foundation and the second section of the foundation defines a wall. Part of the turntable is adapted to rotate within the wall.

20 Claims, 10 Drawing Sheets

ON-SITE ASSEMBLED FOUNDATION MODULE

FIELD OF THE INVENTION

The present invention relates to a device and method for the installation of machinery in a foundation, more particularly, the invention relates to a device and method for installing a turntable where the device is sized for the turntable and may be assembled on site.

BACKGROUND OF THE INVENTION

Heavy machinery is found in many factories, rail yards, repair shops and other locations where large items need to be moved and positioned. For example, lifting machinery is necessary to repair rail cars, engines and other railway vehicles and machinery. The lifting machinery is often made up of large support structures using hydraulic pistons, screws or large motors to move machinery. Because of the size of the lifting machinery and the size of machinery to be moved, it is often advantageous to place the lifting machinery below ground level, typically in a foundation.

In the case of a rail car lifting or positioning machinery such as a repair stand or a turntable, it is desirable that the gap between the rails on the ground and the rails on the positioning machine be minimized. In the case of a turntable, the foundation must be sufficiently round so that the turntable can freely rotate without rubbing against the foundation. A difficulty associated with minimizing gaps and rubbing is that the machinery sits in a foundation that is manufactured using concrete forms. The concrete forms may be built from wooden boards and cut and designed on site. The machinery is often built from large steel plates and/or beams that are cut and fit at the point of manufacture. Because the foundation and the machinery are built separately, the foundation often needs modifications when the machinery is installed on site to adjust the tolerances and gaps for ideal operation of the machinery within the foundation.

Current practice uses a number of foundation embedments to create complicated sections of a foundation. In order to properly locate each embedment, a number of variables may need to be properly surveyed or measured to allow for correct installation. Variables include, for example, center, center line, perimeter and depth of the foundation. Locating center alone is often a surveying task that can take a substantial amount of time to complete. Once center is located, a number of holes must be drilled in a flat foundation so that anchor bolts can be installed. The anchor bolts affix the machinery to the foundation, and the pattern of the anchor bolts must be within tight tolerances so that the machinery can easily bolt to the foundation. Again, locating the center and setting the pattern of the bolts can be a lengthy and costly surveying task.

Often, a general contractor responsible for pouring concrete has difficulties achieving the tolerances required for a turntable to operate correctly within a foundation, since the tolerance requirements are typically much higher relative to what is often required of general concrete contractors. Further, locating center and bolt holes within a foundation is a time consuming and expensive process. Additionally, incorrect tolerances may require alterations to foundations after pouring, which are time consuming and labor intensive.

Additionally, current practice for installation of a turntable may require that the turntable is installed in a partially completed foundation, and then the foundation is completed once the turntable is in place. Often, the first part of the foundation is poured, and then the general contractor leaves the job site because of the length of time required to install the turntable, which includes surveying for bolt locations relative to center. Then the turntable is installed, and once installed, the general contractor is brought back to the job site to complete the foundation. This requires additional costs associated with re-mobilizing the general contractor's foundation pouring operations.

U.S. Pat. No. 7,798,067 to Starnes discloses a thin turntable having bearings disposed between a ground-engaging member and a load-supporting platform. A motor support box is located below the ground engaging member, the motor support box housing the motor assembly. An intermediate load transfer unit having bearing elements is located between the ground-engaging member and the load-supporting platform. The ground engaging unit of Starnes does not contain the turntable. The ground-engaging member has load surfaces that interact with the bearings of the intermediate load transfer unit.

U.S. Patent Application Publication No. 2007/0175353 A1 to Jeffs discloses a vehicle turntable with a housing having rollers within the housing. The housing rollers contact and support the turntable member. The vehicle turntable is pre-assembled with the housing, and the housing is an integral part of the turntable's ability to turn. A module adapted to receive completed machinery is not disclosed.

U.S. Pat. No. 7,966,939 to Holt discloses a foundation having a circular trench with an inner ring and an outer ring mounted within the circular trench. The two rings have rollers affixed thereon, and a bar assembly rests on the rollers. The turntable is assembled onto the foundation after the foundation is poured. A module adapted to receive completed machinery is not disclosed.

There is a need for improved lifting and positioning machinery that overcomes the disadvantages of the prior art. Much of the prior art is directed towards avoiding the use of a foundation for machinery such as a turntable. Although avoiding the use of a foundation for some applications may be acceptable, a foundation is often necessary for heavy loads. This avoidance of foundations in the prior art shows a need for a device to aid in the installation of a turntable.

In some cases, the size of the machinery and the installation devices may be rather large, and in some cases may not fit in or on a trailer used for transportation. Often, special permitting and clearances are required to transport items of wide or unusually sized loads, which can add a significant expense to the installation job. Further, a smaller shipping size ultimately reduces shipping costs. It is therefore desirable to provide a device for aiding the installation of a turntable that may be assembled on-site while still providing the required tolerances in order to properly install a turntable in a foundation.

It is therefore an object to provide an on-site assembled foundation module that aids in proper construction and installation of a turntable in a foundation. It is still another object to provide an on-site assembled foundation module that reduces transportation and handling costs. It is yet another object to provide a method of installing a turntable using a foundation module.

SUMMARY OF THE INVENTION

These and other objects are achieved by providing a turntable assembly including a turntable, a foundation module and a foundation. The foundation module is installed in the foundation and adapted to receive the turntable. The foundation module may include a base having a plurality of holes therein. A first set of the plurality of holes in the base are arranged to receive foundation material there through. A second set of the plurality of holes in the base are arranged to receive bolts for securing the turntable to the foundation, and a plurality of frame members are adapted to be affixed to the foundation module. The frame members are at least partially submerged in the foundation to affix the foundation module to the foundation.

The assembly may include a support structure adapted to affix to a flange to resist displacement of the frame members towards a center of the base when the foundation material is poured. The assembly may further include a flange affixed to at least one of the frame members, the flange defining a circumference having a radius and wherein an edge of the frame members affixed to the flange are disposed at distance equal to the radius. The assembly may include a flange affixed to the frame members, the flange defining a first circumference having a first radius. A portion of the flange has at least one edge defining a second circumference having a second radius less than the first radius. A form is adapted to affix to the frame members so that a surface of the form has a radius equal to the first radius.

Yet other objects are achieved by providing a device for installing a turntable in a foundation. The device includes a base having a plurality of holes therein. At least a first one of the plurality of holes is adapted to receive a foundation material there through for pouring a first section of the foundation. A plurality of frame members may be adapted to affix to the base. At least one form may have an outer surface and be adapted to releasably secure to at least one of the plurality of frame members. The outer surface of the form may be adapted retain a portion of the foundation material for pouring a second section of the foundation. The second section of the foundation may define a wall. At least part of the turntable is adapted to rotate within the wall.

The device may include a flange affixed to the frame members that defines a first circumference having a first radius. A portion of the flange may define at least one edge defining a second circumference having a second radius less than the first radius. The surface of the form may have a radius equal to the first radius. The device may further include holes in the frame members have holes with an axis substantially parallel to the base. The holes may be adapted to be submerged in the foundation to affix the frame members to the foundation. The wall may have a radius equivalent to first radius where the portion of the turntable adapted to rotate within the wall has a radius less than the second radius.

Other objects are achieved by providing a method of installing a turntable. The method may include the steps of providing a foundation module defining an opening and adapted to receive at least part of the turntable therein. The foundation module may include a base and at least two frame members. The method may include attaching the frame members to the base and providing a form. The form is attached the frame members, where the form provides an outer surface for retaining the foundation material. The method may further include excavating a hole in the ground, the hole having a size larger than the foundation module. The method may further include pouring a foundation material so that said foundation material is disposed below the base and around the outer surface of the form. Additionally, the method may include affixing the turntable to the foundation where the turntable is adapted to rotate in the foundation module.

The method may further include the step of removing the form. The turntable may be affixed to the foundation with bolts that pass through the base and into the foundation. The step of providing a foundation module may include assembling the foundation module by affixing the frame members to the base such that an edge of each of the frame members is located at a distance from a center of the base so that the form can be attached to the frame members, where the outer surface of the form is in contact with each of the edges.

The bolts for attaching the turntable to the foundation may be affixed to the base prior to pouring the foundation material below the base.

The method may further include providing a support adapted to affix to the foundation module to resist displacement of the outer surface towards a center of the foundation module. The base may include a plurality of holes therein, with at least one of the holes adapted to receive the foundation material. Further, the base may include a plurality of holes therein, at least one of the holes is adapted to receive bolts for affixing the turntable to the foundation. The pouring step may include pouring the foundation material through holes in the base to create a first section of the foundation disposed below the base. The form may be attached to the frame member with a securing device and the method may further include removing the form member by releasing the securing device. The removing step may include cutting the securing the device and/or untying the securing device.

DETAILED DESCRIPTION OF THE INVENTION

Figure 1:
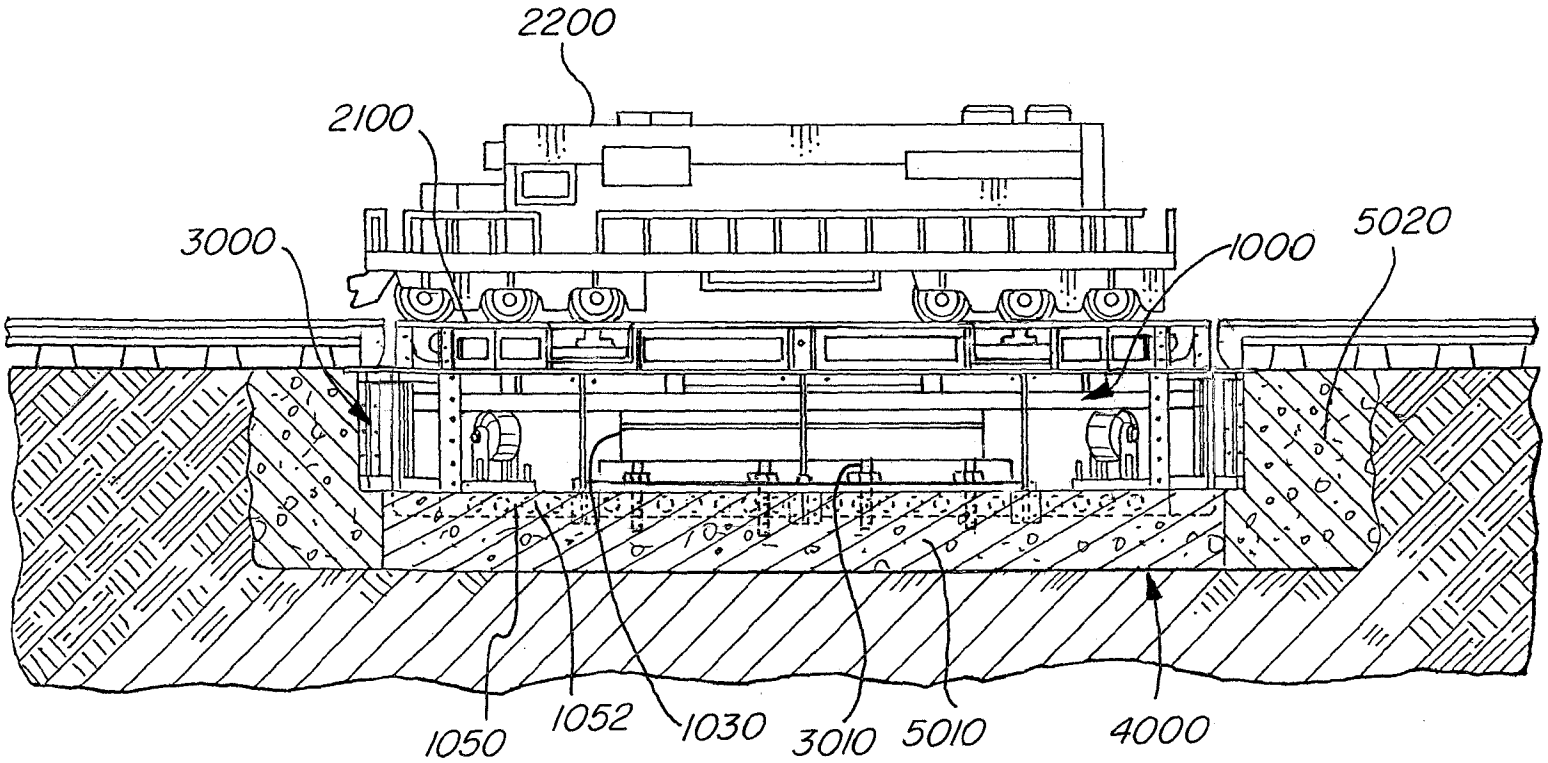
FIG. 1 is a side schematic cutaway view of a turntable installed in a foundation using a foundation module according to an exemplary embodiment.

As shown in FIG. 1, a turntable 1000 is installed in a foundation 4000 using a foundation module 3000. The turntable 1000 has track sections 2100 thereon for receiving a rail car 2200 such as a locomotive. The turntable 1000 can rotate around its hub 1030 within the foundation module 3000 bolts 3010 extend through holes in the base of the foundation module and into the bottom section of the foundation 5010. The bolts also extend through the hub 1030, thus allowing the turntable to be affixed to the foundation. The foundation may be made in two pours that define two sections 5010 and 5020. The first pour may be below the base of the foundation module 3000. The second pour 5020 may define the walls of the foundation. Often, in the case of a turntable, the walls will be round. The foundation module 3000 has a number of frame members that may be welded or bolted together to make up the structure of the module 3000. As shown, some of the frame members 1050 are disposed below the base of the foundation module, a series of holes 1052 in the frame members are submerged in the foundation. These holes 1052 may aid to affix the foundation module to the foundation. The walls may be defined by the edges of frame members, such as frame member 1060, and these walls are located at a distance from center of the base. Forms such as sheet metal, plastic, wood or other generally planar material may be affixed to the edges of the frame members to create a form for the foundation and to define the boundaries of the second pour 5020.

The forms may be rigid or flexible. If flexible, the forms would be designed to be affixed to the edges of the frame members and the forms would bend slightly to conform to the inner circumference defined by the inner edges of the frame members. These forms may be designed to be releasably secured to the frame members, for example, with rope or zip ties or other securing device 1202. The securing device 1202 may pass through holes in the forms and through holes in the frame members. To remove the forms, the securing device 1202, such as a zip tie, is cut and the forms are removed once the foundation has cured. It is also contemplated that bolts and other types of fasteners can be used to secure the forms to the frame members. The forms may be multiple pieces that can be secured to the frame members, or optionally one piece that can secure around the entire inner circumference defined by the edges of the frame members. Optionally, the wall frame members 1060 and base frame members 1050 are each sections of a single frame member. The wall frame members 1060 can also be secured to the base or other frame members by bolts in order to assemble the foundation module 1000. It would also be understood that the frame members may have cross sections that would secure the foundation module to the foundation when submerged in concrete. For example, an "I" beam, an "L" channel, a "U" channel or other appropriate shape. Typically, at least one surface of the frame member or a hole therein would be disposed parallel to and facing the bottom surface of the plate. Thus when concrete is poured between the bottom surface of the plate and the parallel surface of the frame member, the frame member would be submerged in the concrete and the surface of the frame member would resist pull out, thus securing the foundation module to the foundation.

Figure 2A:
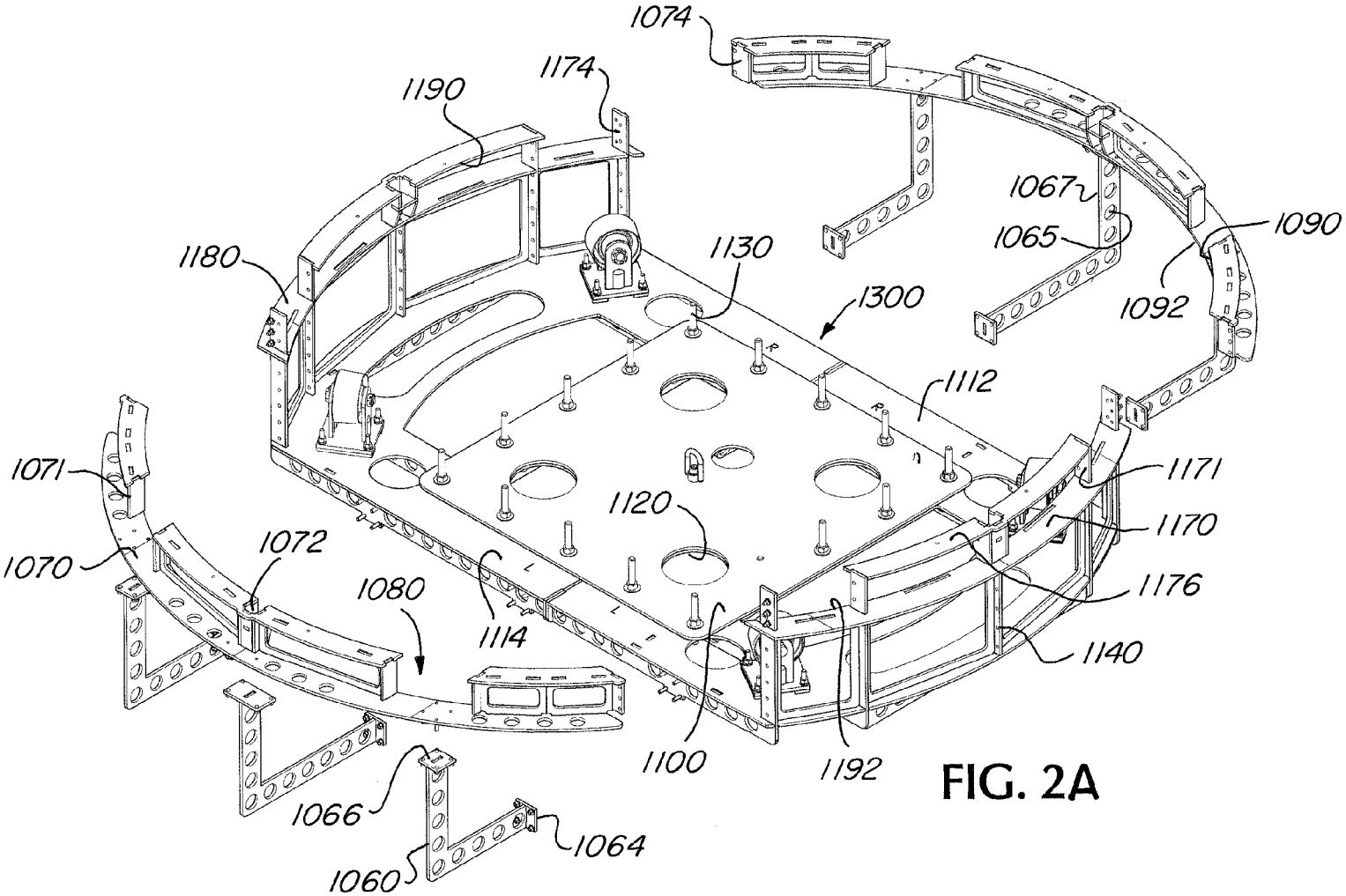
FIG. 2A is a top perspective exploded view of the foundation module of FIG. 1 according to an exemplary embodiment.

FIG. 2A shows a base plate 1100 having pour holes 1120 therein. As shown the base plate has five (5) pour holes, however, the set of pour holes can include a single pour hole or multiple pour holes. Although round holes are shown, other shapes are contemplated within the scope of the present invention. The base plate can also be a thin strip that is used as a template to define the location of the holes 1130 for the hub. As shown, the base plate is attached to a central frame structure 1200 by the bolts 1130. The base plate 1100 may also be removable so that the foundation may be poured beneath the frame plate 1110 and then the base plate 1100 is secured to the bolts 1130 as shown. This may provide easier access to the structure below the base plate and may allow for easier distribution and leveling of the foundation material. As shown, frame plate 1110 is part of the central frame structure, and the base plate 1100 is attached to the frame plate 1110. The base plate may also be integral to the central frame structure 1200, for example, the base plate would have the holes that receive the bolts 1130 as well as the structure that attaches to the frame sections below the base. The pattern of holes for the bolts 1130 is designed to receive the machinery that is to be installed in the foundation, for example, a turntable. The frame plate 1110 may also have a series of pour holes therein for receiving foundation material below the outer surface of the frame plate. Bolts 1130 pass through the pattern of holes for the hub and into the foundation. These bolts may be affixed before pouring, or alternately, the pattern of holes for bolts 1130 may be used to install the bolts in a cured or partially cured foundation once the foundation is poured beneath the base plate. Optionally, the base plate may be made of multiple parts that can be bolted or otherwise attached together.

Frame members 1060 have an end plate 1064 for affixing the frame members 1060 to the base plate 1120 or to other frame members. As shown in the figure, the end plates affix to a frame member that is disposed below the base plate 1130. A top plate 1066 of the frame members 1060 has a similar pattern of holes for affixing to a flange 1070. The flange is optionally a rounded section that defines the opening of the foundation module when the frame members and flanges are assembled together. Lock pocket 1072 in the flange may be used to interact with a locking mechanism of a turntable that would extend from the turntable to prevent rotation. The flanges 1070, 1170 can have flange plates 1174, 1074 that bolt together to define the foundation opening. Top surface 1076 of a section of the flange is designed to be substantially on the same plane as the shop floor and thus approximately level with the top surface of the rails or track sections coming into the turntable. The openings 1080, 1180 in the flange are designed to accommodate rails that align with the track sections 2100 of the turntable.

There are a number of structures 1071 and 1171 that are affixed to and/or integral with the flanges 1070 and 1170. The top surfaces of these structures 1076 and 1176 are designed to sit approximately level with the top surface of the incoming rails. The inner circumference 1092, 1192 of the flanges 1170, 1070 is of a greater diameter than the inner circumference 1090, 1190 of the structures 1071, 1171 that are affixed above the flanges. This creates a lip or overhang that can allow for foundation forms 1200 to sit within the gap and to provide extra space for the turntable to rotate within the foundation or foundation module. As shown, the foundation forms cover the track openings 1080, however the forms may have cutouts if the forms are designed as permanent parts of the foundation. Optionally, the forms may have holes therein, where a securing device 1202 such as string, or zip ties pass through the holes and affix to the holes 1065 in the frame members. Once the foundation cures, the securing device 1202 is cut or removed, and the forms 1200 are likewise removed. The setback or gap 1194 (see FIG. 6), provides additional tolerances that reduce the likelihood of the foundation curing in a way where the turntable will encounter an obstruction. The turntable is designed to operate within the circumference 1092, 1192 defined by the edges of the structure 1071, 1171.

The central frame structure 1300 can have a number of support wheels 1050 that are designed to support the turntable to add further rigidity to the structure. The frame plate 1110 or optionally, the base plate 1100 can have a pattern of holes designed to receive the wheels 1050. The turntable may have a particular track or surface thereon that the wheels are designed to roll on. The location of the wheels and the appropriate angle thereof would likewise be important to align with correct tolerances. Since the frame plate 1110 or base plate 1100 may be cut on a two dimensional cutting machine, such as a water jet, the location of the holes are pre-set with appropriate tolerances according to the design of the turntable. The central frame structure 1300 can also have members 1140 disposed at a distance from center of the frame structure 1300, where the distance allows the turntable to rotate within the foundation module. It is also contemplated that members 1140 may be secured with bolts to the base or frame plates. In this case, the end plates shown on frame members 1160 could be adapted to work with members 1140 so that members 1140 can bolt to the base or frame plates for assembly of the foundation module.

In order to aid in the assembly of the foundation module, parts of the assembly may be marked 1112, 1114 to indicate which parts assemble in which location. For example, mark 1112 is an "R" which may designate the right side.

Figure 2B:
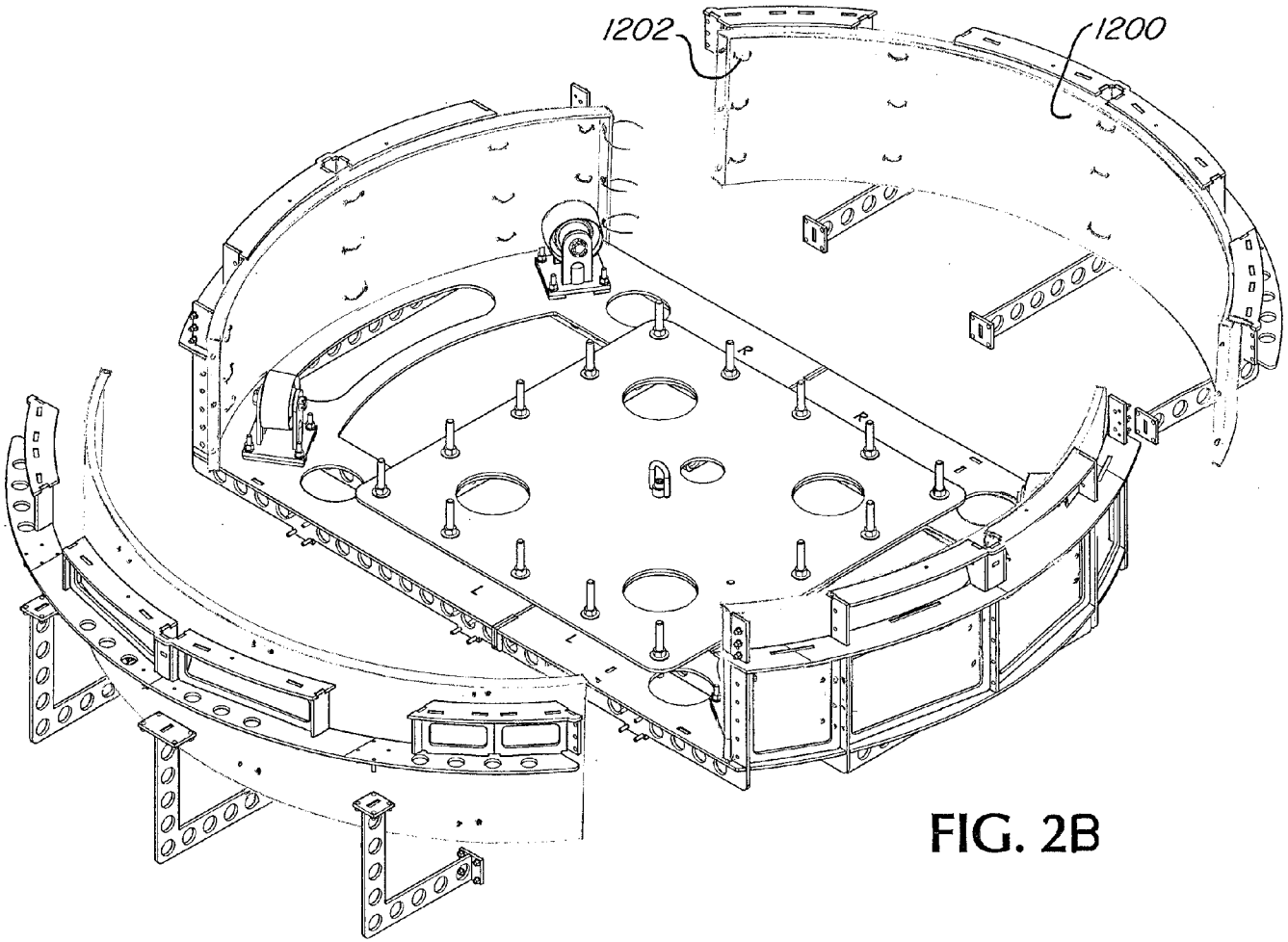
FIG. 2B is a top perspective exploded view of FIG. 2B with the addition of forms that attach to the foundation module according to an exemplary embodiment.

FIG. 2B shows the forms 1200 that can be affixed to the edges 1063 of the frame members. Although shown as multiple pieces, the forms could be designed as a single piece of sheet metal, or alternately, the forms could be made of a planar or rigid material, and each of the forms could define a generally planar section of the wall of the foundation that aligns with the edges of two adjacent frame members. If the forms are made of a rigid material, the resulting wall of the foundation could likewise be multiple generally flat sections that are disposed around the circumference. As shown, the forms are either flexible or pre-bent to the inner circumference as defined by edges 1092, 1192. The forms 1200 can be designed to be permanent, and therefore would have holes or voids therein so that the gap 1080 for the rails would also exist in the forms. If the forms are permanent, they may be welded to the frame members 1060 on site. As previously discussed, the forms can be drilled with holes that receive a securing device 1202 such as, for example, a zip tie, wire or rope. The securing device 1202 passes through holes in the forms that are adjacent to the holes 1065 in the frame members. When the forms are removed, the securing devices 1202 are cut to allow for removal. The forms may be made of a number of materials, for example, sheet metal, plywood or plastic. Other materials are contemplated, and these examples should not be seen as limiting.

Figure 3:
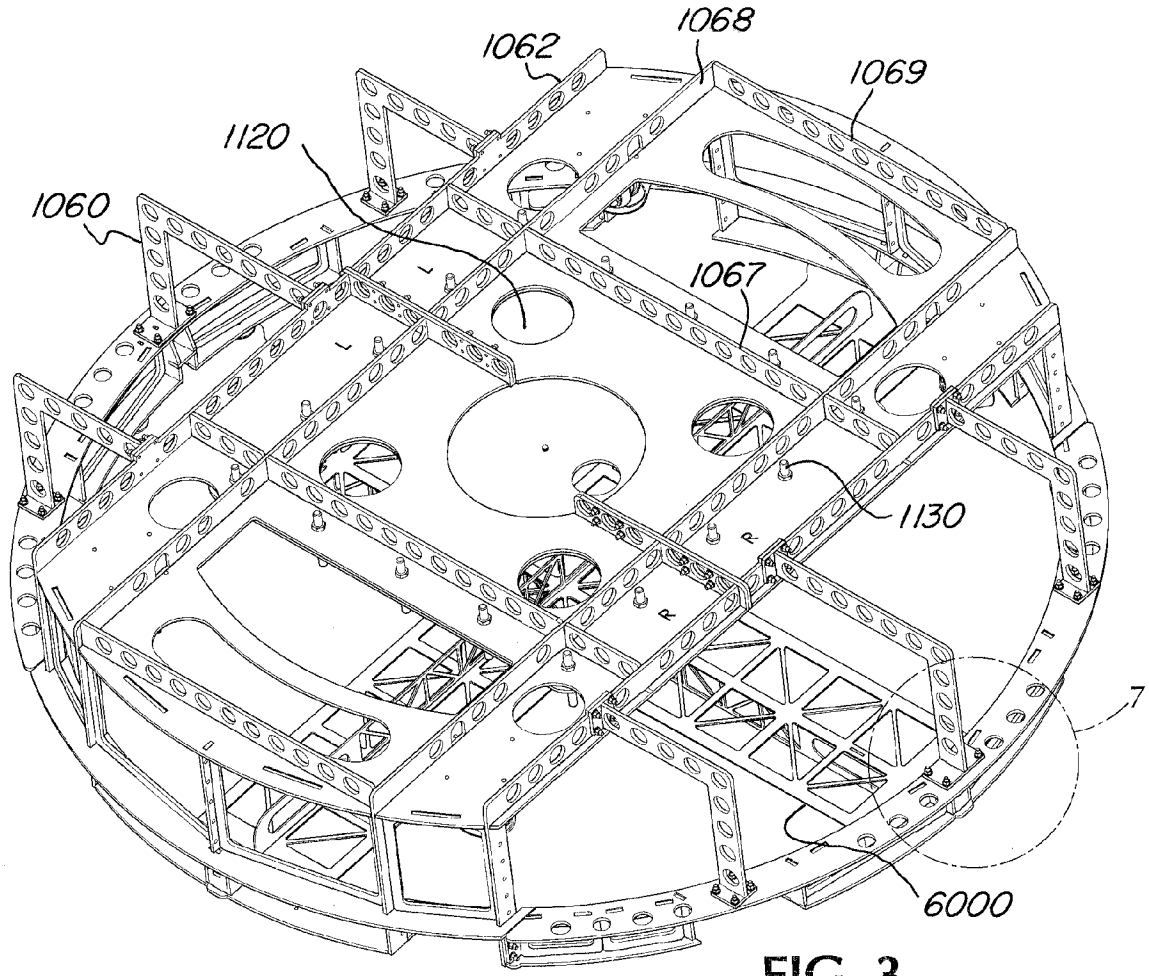
FIG. 3 is a bottom perspective view of the foundation module of FIG. 1 according to an exemplary embodiment.

It is understood that during shipment, the frame members, forms and other pieces of the foundation module can all be arranged within a smaller space than if the frame members arrived at the installation site already affixed to the base. It is also understood that all sections of the frame members that define the vertical wall may be removable or adapted to assemble on site. This includes those sections of the frame members that are shown in the drawings as already affixed to the base and or frame plates FIG. 3 shows the underside of the foundation module. Frame members such as members 1068 and 1069 are disposed below the frame structure 1200 and provide increased rigidity to the foundation as well as help secure the foundation module to the foundation. The bolts 1130 extend below the outer surface of the frame structure 1200 or the base plate so that part of the bolts may be submerged in the foundation. Frame members 1067 may extend around a perimeter adjacent to the pattern of holes that receive the bolts. Since the turntable will be located at the bolts, the frame members may provide additional rigidity to the foundation structure.

Figure 4:
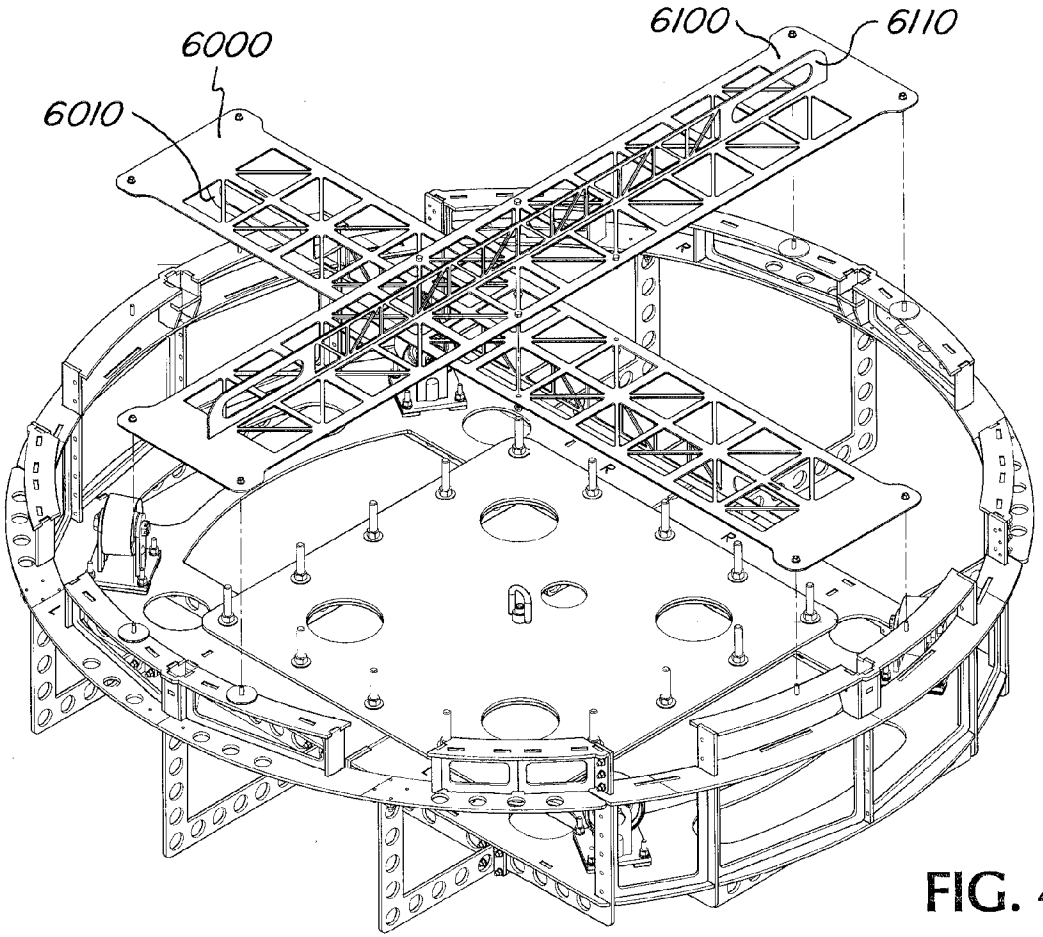
FIG. 4 is a top perspective view of the foundation module of FIG. 1 having a support structure according to an exemplary embodiment.

FIG. 4 shows the top support 6000, 6100 that is used during the installation process to support the flanges 1070, 1170 in order to resist the weight of the concrete from pushing the walls or frame members of the foundation module inward. This prevents the foundation from curing outside of the desired tolerances, which likewise can eliminate additional work that would require chipping away at the foundation in order for the turntable to operate smoothly within the foundation module.

Figure 5:
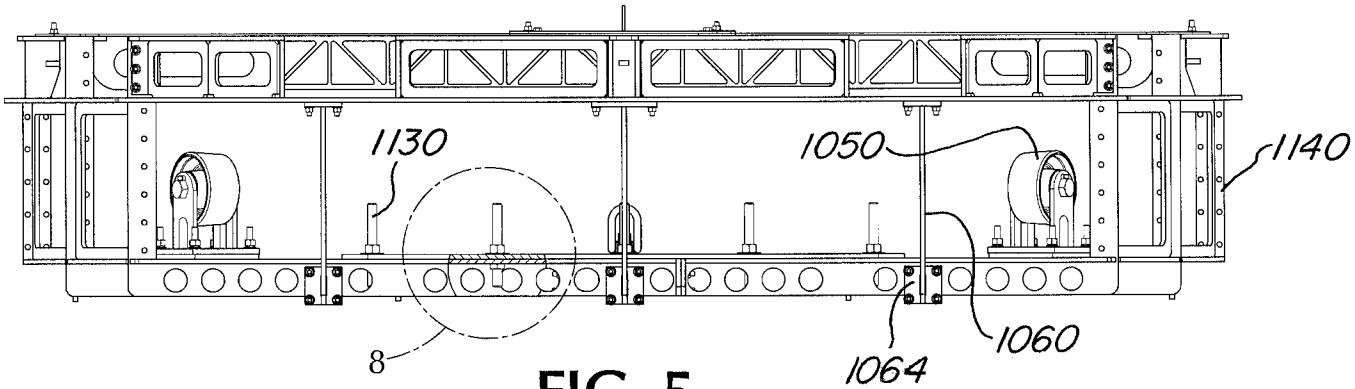
FIG. 5 is a side view of the foundation module of FIG. 1 according to an exemplary embodiment.

FIG. 5 shows the bolts 1130 extending above the base and the end plate 1064 that affixes to the base and/or the frame members below the base. The top plate 1066 affixes to the flange and frame member 1140 of the base extends from the base. Support wheel 1050 may be included to provide additional support of the turntable and to provide additional stiffness for resisting the heavy loads of the machinery, products, materials and or rail cars that are placed on the turntable.

Figure 6:
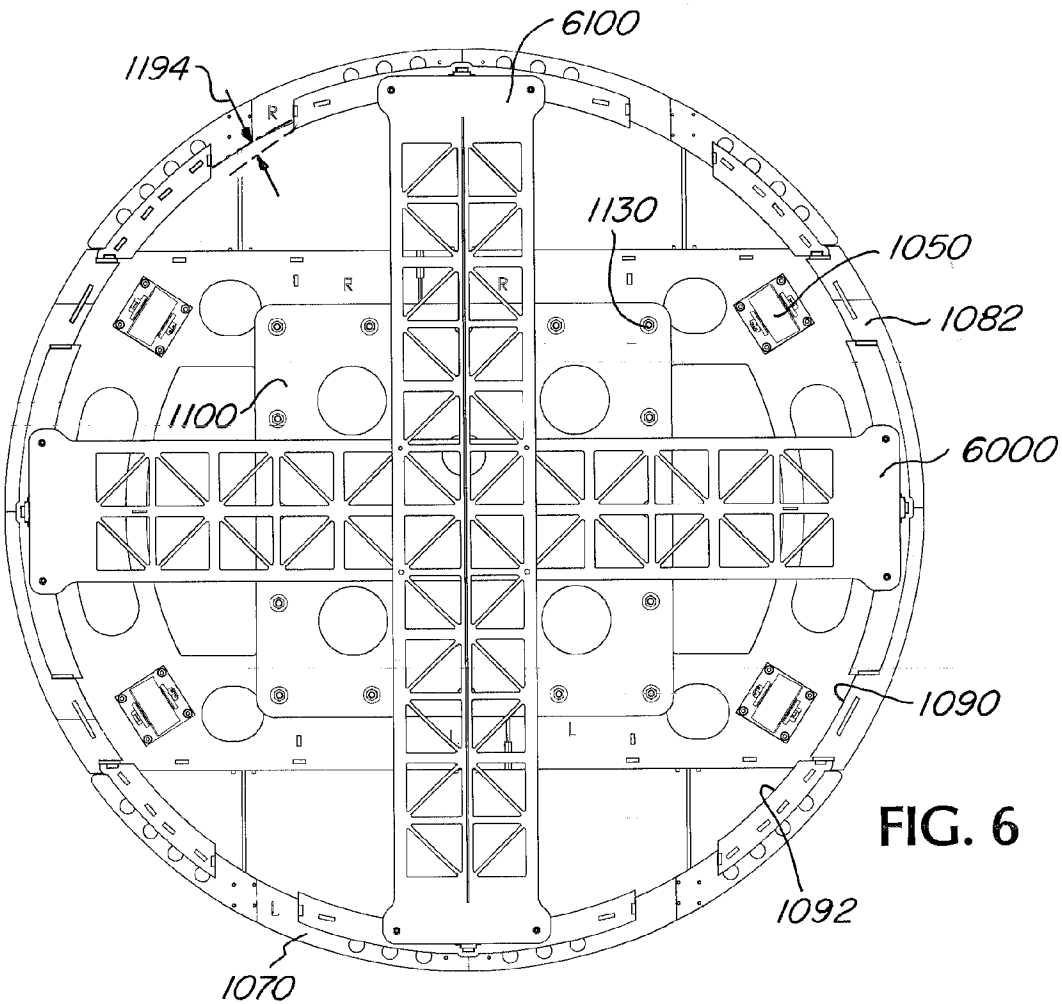
FIG. 6 shows a top view of the foundation module of FIG. 1 according to an exemplary embodiment.

As shown in FIG. 6, there are two circumferences associated with the flange. This results in a gap 1194. This gap provides extra space to allow the turntable to rotate in the foundation. It is important that the foundation is built so that the dimensions will allow the turntable to freely rotate in the foundation. The outer surface of the forms 1200 may contact the edge along the circumference defined by edge 1090. The turntable is sized to rotate in the circumference 1092. The lock pockets 1072 are located on the flange, and these lock pockets allow a locking mechanism on the turntable to extend into the lock pocket to prevent the turntable from rotating, for example, when a rail car is entering or leaving the turntable.

Figure 7:
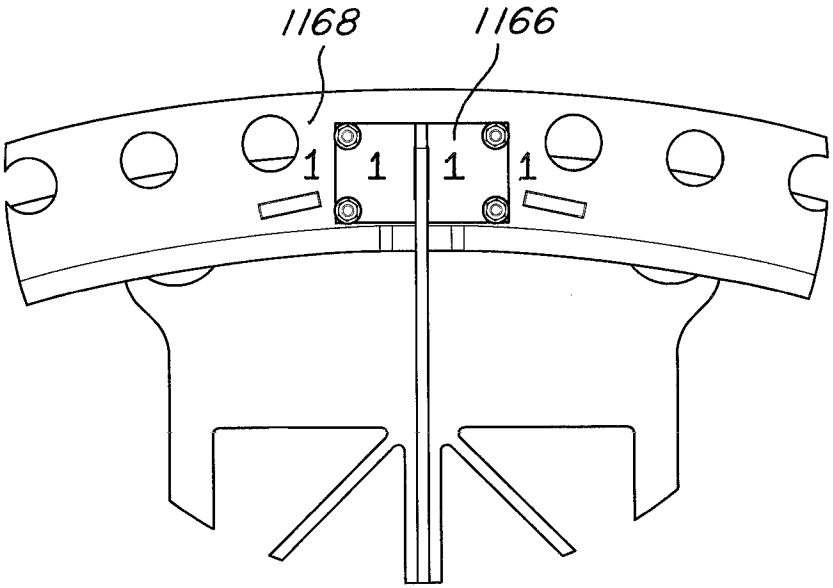
FIG. 7 is a detail view of FIG. 3 according to an exemplary embodiment.

FIG. 7 is a detail view shown in FIG. 3. Plate 1066 bolts to flange 1070 to assemble the foundation module. Markings 1168 and 1166 indicate where each frame member 1060 is designed to affix to the flange. It should be understood that each location where parts of the foundation module assembly bolt together can include similar markings or indicators. Although numbers are shown, colors, pictures or other symbols can be used to aid in the assembly of the foundation receiver.

Figure 8:
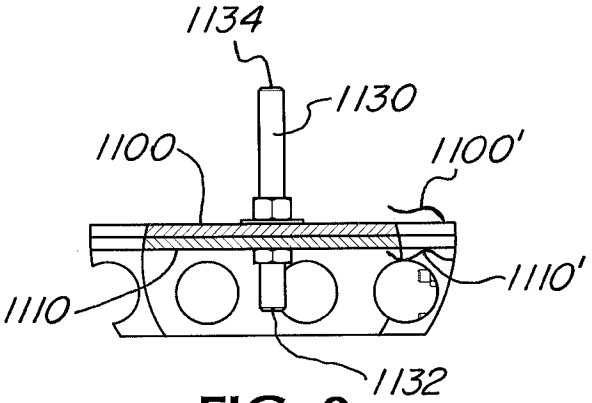
FIG. 8 is a detail view of FIG. 5 according to an exemplary embodiment.

FIG. 8 is a detail view of a bolt 1130 extending above the inner surface 1100' of the base plate 1100, and extending below the outer surface 1110' of the frame plate 1110. The lower end 1132 of the bolt is submerged in the foundation, and the upper end 1134 of the bolt receives the hub or other attachment point of the turntable. It would also be understood that the base plate 1100 can include the holes, for receiving the bolts 1130 as well as the pour holes and other structure of the frame plate 1110. In this case, there would not be two separate plates used for defining the floor or bottom section of the foundation. In this case, the foundation material would sit below the outer surface of the base plate 1100, and the turntable would affix at the upper end 1134 of bolts that extend above the inner surface of the base plate 1100.

Figure 9A:
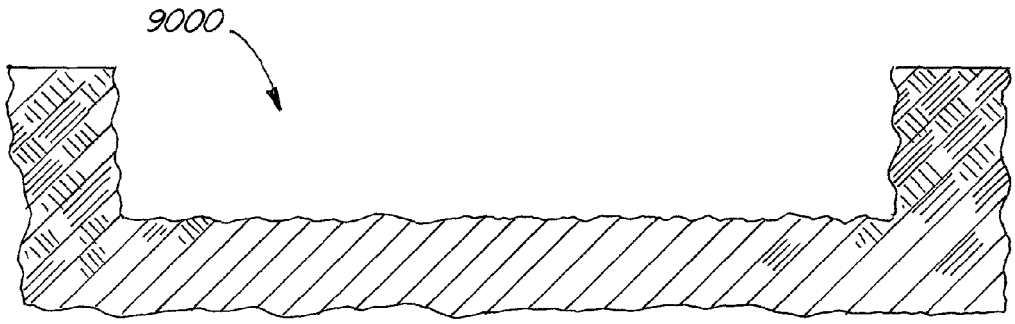
FIGS. 9A-9D are exemplary method schematics showing a method of installing the device shown in FIG. 1.

FIGS. 9A-9D show an exemplary method of installing a turntable. FIG. 9A shows the prepared installation site, which may be an excavated hole 9000 in the ground. It is also contemplated that the turntable or machinery can be installed at a level other than below ground level. For example, the bottom of the turntable or part thereof can sit at approximately ground level and a secondary form can be built around the outside of the foundation module so that a channel exists between the secondary form and the foundation module, where the wall of the foundation (or part thereof) is above ground level. For example, the turntable may be installed on a hill where part of the foundation is exposed and part of the foundation is located in the ground.

Figure 9B:
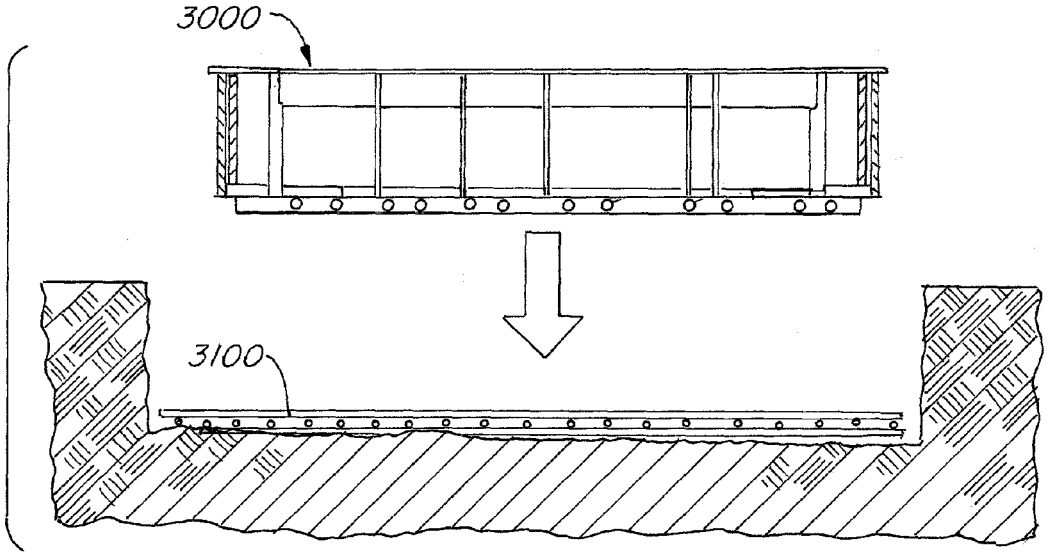
Figure 9C:
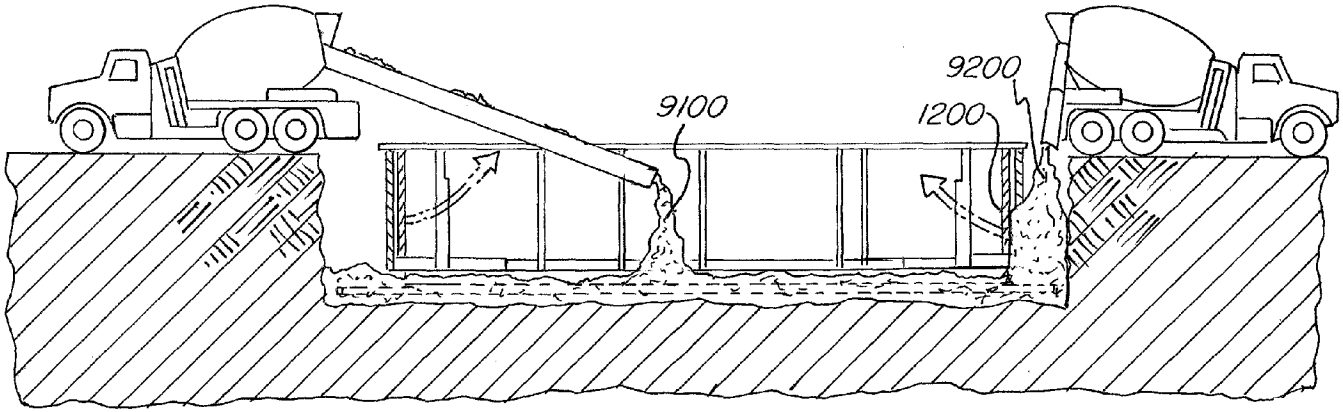

FIG. 9B shows an assembled foundation module 3000 being installed in the hole 9000. As shown, the foundation module has already been assembled prior to being placed in the hole. It is understood that the installation process of assembling the various base and frame sections together may take place wholly or partially inside or outside the hole or installation site. The form 1200 is fitted to the foundation module 3000. When the foundation module 3000 is installed in the hole 9000, a structure 3100 may be placed in the hole. This structure 3100 may be reinforcement bar, or "re-bar" as commonly referred to in the industry. The re-bar may be welded directly to the foundation module and/or frame sections. The foundation module can also be leveled inside the hole 9000 using the structure 3100. The structure can also include stone, bricks, concrete blocks, gravel and other material that can be used below or within the foundation.

Once the foundation module and forms 1200 are placed in the hole, the foundation material 9200/9100 can be poured around the outer surface of the forms and beneath the foundation module. As shown in the previous figures, for example FIG. 2, there are a number of holes in the base of the foundation module that can receive concrete. As shown, the foundation material 9100 poured into one of the holes that receive foundation material as previously shown and described. It is understood that the foundation material may be poured into some or all of the holes. It is also understood that the foundation material may be poured between the frame members. In one embodiment, the foundation material is poured so that the foundation contacts the bottom or outer surface of the base. The foundation material may also be substantially level with an edge of the frame members that is parallel to the base so that such edge is exposed. It is also contemplated that the entirety of the frame members may be submerged in concrete.

The vertical edges of the frame members and the outer surface of the form define the wall of the foundation. Foundation material 9200 is poured into the channel between the hole and the form 1200 that defines the wall of the foundation. The foundation may be poured in two stages, for example first pour 9100 creates the floor or bottom section of the foundation. The second pour 9200 creates the wall or side of the foundation. The second pour may be done after the first pour has cured or otherwise dried. It is understood that the first pour may be partially cured or dried when the second pour is done. The second pour may also be done before the first pour where appropriate. It is also understood that the first and second pours may be simultaneous or done by the same or multiple cement trucks or mixers.

Prior to the second pour, the support structure as shown in FIG. 4 may be affixed to the frame member and/or the flange of the foundation module as shown in FIG. 4. This support structure may resist displacement of the forms 1200 and frame members 1060 due to the weight of the foundation material 9200.

Figure 9D:
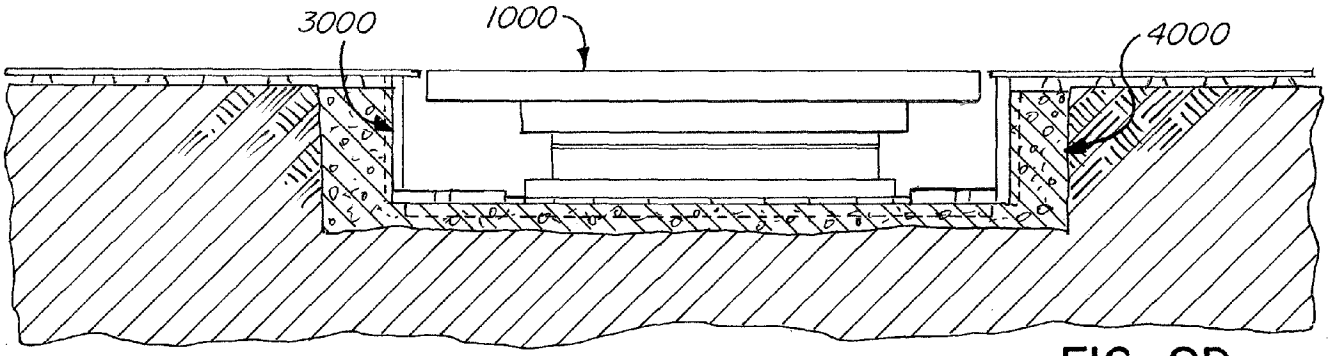

FIG. 9D shows the turntable installed in the foundation where the foundation module is between the turntable and the foundation and the forms 1200 have been removed. The tracks are installed to align with the installation module and fit in the gaps 1080, 1180 along the flange where appropriate.

The terms "first," "second," "left" and "right" are used to distinguish one element, set, object or thing from another, and are not used to designate relative position or arrangement in time. Likewise, the terms "bottom," "top," "inner," "outer," "front," and "back" are used in reference to the exemplary embodiments shown in the drawings and are used to distinguish one element from another and not to designate a relative position or arrangement.

What is claimed is:

1. A turntable assembly comprising:
a turntable;
a foundation module;
a foundation, said foundation module installed in said foundation and adapted to receive said turntable, wherein said foundation module includes:
a base having a plurality of holes therein,
a first set of the plurality of holes in said base are arranged to receive foundation material there through, and
a second set of the plurality of holes in said base are arranged to receive bolts for securing the turntable to said foundation,
a plurality of frame members adapted to be affixed to said foundation module;
wherein said frame members are at least partially submerged in said foundation to affix said foundation module to said foundation.

2. The assembly of claim 1 further including a support adapted to affix to a flange at least two points to resist displacement of the frame members towards a center of the base when the foundation material is poured around the foundation module.

3. The assembly of claim 1 further comprising a flange affixed to at least one said frame members, said flange defining a circumference having a radius and wherein an edge of said frame members affixed to said flange are disposed at distance equal to the radius.

4. The assembly of claim 1 further comprising:
a flange affixed to said frame members and defining a first circumference having a first radius;
a portion of said flange having at least one edge defining a second circumference having a second radius less than the first radius;
a form adapted to affix to said frame members so that a surface of the form has a radius equal to the first radius.

5. A device for installing a turntable in a foundation comprising:
a base having a plurality of holes therein;
at least a first one of the plurality of holes adapted to receive a foundation material there through for pouring a first section of the foundation;
a plurality of frame members adapted to affix to said base;
at least one form having an outer surface, said form adapted to releasably secure to at least one said plurality of frame members, wherein the outer surface of the form is adapted retain a portion of the foundation material for pouring a second section of the foundation wherein the second section of the foundation defines a wall;
wherein at least part of the turntable is adapted to rotate within the wall.

6. The device of claim 5 further comprising:
a flange affixed to said frame members and defining a first circumference having a first radius;
a portion of said flange defining at least one edge defining a second circumference having a second radius less than the first radius;
wherein the surface of the form has a radius equal to the first radius.

7. The device of claim 6 wherein said frame members have holes with an axis substantially parallel to said base, and the holes are adapted to be submerged in the foundation to affix the frame members to the foundation.

8. The device of claim 6 wherein the wall has a radius equivalent to first radius and wherein the portion of the turntable adapted to rotate within the wall has a maximum radius less than the second radius.

9. A method of installing a turntable, the method comprising:
providing a foundation module defining an opening and adapted to receive at least part of the turntable therein, said foundation module including a base and at least two frame members;
attaching the frame members to the base;
providing a form and attaching said form to the frame members, the form providing an outer surface for retaining the foundation material;
excavating a hole in the ground, the hole having a size larger than the foundation module;
pouring a foundation material so that said foundation material is disposed below the base and around the outer surface of said form; and affixing a turntable to the foundation wherein the turntable is adapted to rotate in said foundation module and the installation module is disposed between the foundation and the turntable.

10. The method of claim 9 further comprising the step of removing the form.

11. The method of claim 10 wherein the turntable is affixed to said foundation with bolts that pass through the base and into the foundation.

12. The method of claim 9 wherein said step of providing a foundation module further comprises:

assembling said foundation module by affixing said frame members to said base such that an edge of each of the frame members is located at a distance from a center of said base such that said form may be attached to said frame members so that the outer surface of said form is in contact with each of the edges.

13. The method of claim 12 wherein bolts for attaching the turntable to the foundation are affixed to the base prior to pouring the foundation material below the base.

14. The method of claim 9 further comprising:

providing a support adapted to affix to at least two points of the installation module to resist displacement of opposing frame members towards a center of the base when the foundation material is poured around the foundation module.

15. The method of claim 9 wherein said base includes a plurality of holes therein, at least one of said holes is adapted to receive the foundation material.

16. The method of claim 9 wherein said base includes a plurality of holes therein, at least one of said holes is adapted to receive bolts for affixing the turntable to the foundation.

17. The method of claim 9 wherein said pouring step comprises pouring said foundation material through holes in said base to create a first section of the foundation disposed below the base.

18. The method of claim 9 wherein said form is attached to said frame member with a securing device, the method further comprising:

removing said form member by releasing the securing device.

19. The method of claim 18 wherein said removing step includes cutting the securing device.

20. The method of claim 9 wherein said attaching step includes bolting the frame members around a periphery of the base such that an edge of each frame member is disposed in a substantially vertical orientation, each frame member having an edge located at a radius measured from a center of the base; and said pouring step includes pouring the foundation material so that at least a portion of the frame members are submerged in the foundation.

* * * * *